US010627732B2

(12) United States Patent
Ogino et al.

(10) Patent No.: US 10,627,732 B2
(45) Date of Patent: Apr. 21, 2020

(54) TONER, DEVELOPER, TONER STORAGE UNIT, IMAGE FORMING APPARATUS, IMAGE FORMING METHOD, AND METHOD FOR PRODUCING PRINTED MATTER

(71) Applicants: Kohtaroh Ogino, Shizuoka (JP); Yoshitaka Yamauchi, Shizuoka (JP); Akihiro Kaneko, Shizuoka (JP); Kazumi Suzuki, Shizuoka (JP); Hisashi Nakajima, Shizuoka (JP)

(72) Inventors: Kohtaroh Ogino, Shizuoka (JP); Yoshitaka Yamauchi, Shizuoka (JP); Akihiro Kaneko, Shizuoka (JP); Kazumi Suzuki, Shizuoka (JP); Hisashi Nakajima, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/911,285

(22) Filed: Mar. 5, 2018

(65) Prior Publication Data

US 2018/0267418 A1 Sep. 20, 2018

(30) Foreign Application Priority Data

Mar. 14, 2017 (JP) ..... 2017-048644

(51) Int. Cl.
*G03G 9/087* (2006.01)
*G03G 9/08* (2006.01)
(Continued)

(52) U.S. Cl.
CPC ..... *G03G 9/08755* (2013.01); *G03G 9/081* (2013.01); *G03G 9/0819* (2013.01);
(Continued)

(58) Field of Classification Search
CPC ..... G03G 9/08755; G03G 9/08795; G03G 9/08782; G03G 9/08797; G03G 9/081;
(Continued)

(56) References Cited

U.S. PATENT DOCUMENTS 8,795,940 B2 * 8/2014 Sugimoto ..... G03G 9/0804 399/252
2006/0029433 A1 2/2006 Saito et al.
(Continued)

FOREIGN PATENT DOCUMENTS

JP 2001-356527 * 12/2001
JP 2012-150467 8/2012
(Continued)

OTHER PUBLICATIONS

Machine Translation of JP2001-356527.*
(Continued)

*Primary Examiner* — Thorl Chea
(74) *Attorney, Agent, or Firm* — Oblon, McClelland, Maier & Neustadt, L.L.P.

(57) ABSTRACT

A toner is provided. The toner includes at least two types of polyester resins and a release agent. When the toner is subjected to a dynamic viscoelasticity measurement at a frequency of 6.28 rad/sec to obtain a temperature-dependent curve of loss tangent (tan δ), and the temperature-dependent curve is differentiated one time with temperature, a resulting curve has a maximum value of 0.07 or more and a minimum value of 0.025 or less within a temperature range of from 85° C. to 110° C. When the toner is subjected to a differential scanning calorimetry (DSC), an endothermic amount measured in a first temperature rising in the DSC is 3.5 J/g or less within a temperature range of from 85° C. to 120° C.

13 Claims, 8 Drawing Sheets

(51) Int. Cl.

| | |
|---|---|
| ***G03G 15/05*** | (2006.01) |
| ***G03G 21/18*** | (2006.01) |
| *G03G 15/08* | (2006.01) |

(52) U.S. Cl.
CPC ..... *G03G 9/08782* (2013.01); *G03G 9/08795* (2013.01); *G03G 9/08797* (2013.01); *G03G 15/0806* (2013.01); *G03G 15/0822* (2013.01); *G03G 21/18* (2013.01)

(58) Field of Classification Search
CPC . G03G 15/0822; G03G 21/18; G03G 15/0806
See application file for complete search history.

(56) References Cited

U.S. PATENT DOCUMENTS

| | | | | |
|---|---|---|---|---|
| 2009/0239170 | A1 | 9/2009 | Honda et al. | |
| 2010/0021209 | A1 | 1/2010 | Watanabe et al. | |
| 2010/0035170 | A1* | 2/2010 | Sugimoto ..... | G03G 9/0804 430/108.2 |
| 2014/0255840 | A1 | 9/2014 | Sekiguchi et al. | |
| 2015/0024322 | A1* | 1/2015 | Sugimoto ..... | G03G 9/08755 430/109.4 |
| 2016/0327884 | A1 | 11/2016 | Nakajima et al. | |
| 2017/0082933 | A1 | 3/2017 | Dan et al. | |
| 2017/0139337 | A1 | 5/2017 | Kaneko et al. | |
| 2017/0212442 | A1 | 7/2017 | Ogino et al. | |

FOREIGN PATENT DOCUMENTS

| | | |
|---|---|---|
| JP | 2013-054178 | 3/2013 |
| JP | 2014-174262 | 9/2014 |
| JP | 2015-148668 | 8/2015 |
| JP | 2016-070956 | 5/2016 |

OTHER PUBLICATIONS

U.S. Appl. No. 15/536,531, filed Jun. 15, 2017, Natsuko Matsushita, et al.
U.S. Appl. No. 15/567,631, filed Oct. 19, 2017, Yoshitaka Yamauch, et al.
Imoto Minoru, "Basic Theory of Gluing" Macromolecule Publication Meeting, pp. 89-103.

* cited by examiner

TONER, DEVELOPER, TONER STORAGE UNIT, IMAGE FORMING APPARATUS, IMAGE FORMING METHOD, AND METHOD FOR PRODUCING PRINTED MATTER

CROSS-REFERENCE TO RELATED APPLICATIONS

This patent application is based on and claims priority pursuant to 35 U.S.C. § 119(a) to Japanese Patent Application No. 2017-048644, filed on Mar. 14, 2017, in the Japan Patent Office, the entire disclosure of which is hereby incorporated by reference herein.

BACKGROUND

Technical Field

The present disclosure relates to a toner, a developer, a toner storage unit, an image forming apparatus, an image forming method, and a method for producing printed matter.

Description of the Related Art

In an electrophotographic apparatus or an electrostatic recording apparatus, an electrostatic latent image or a magnetic latent image is visualized with toner. For example, in electrophotography, an electrostatic latent image is formed on a photoconductor and developed into a toner image with toner. The toner image is transferred onto a transfer material, such as paper sheet, and fixed thereon by application of heat, etc.

In recent years, toner is required to be fixable at low temperatures in order to save energy by reducing energy required for fixing image. This requirement is increasing due to a demand for image forming apparatus having a higher processing speed and forming an image with high quality as well as recent diversification of use purpose of image forming apparatus.

SUMMARY

In accordance with some embodiments of the present invention, a toner is provided. The toner includes at least two types of polyester resins and a release agent. When the toner is subjected to a dynamic viscoelasticity measurement at a frequency of 6.28 rad/sec to obtain a temperature-dependent curve of loss tangent (tan δ), and the temperature-dependent curve is differentiated one time with temperature, a resulting curve has a maximum value of 0.07 or more and a minimum value of 0.025 or less within a temperature range of from 85° C. to 110° C. When the toner is subjected to a differential scanning calorimetry (DSC), an endothermic amount measured in a first temperature rising in the DSC is 3.5 J/g or less within a temperature range of from 85° C. to 120° C.

In accordance with some embodiments of the present invention, a developer is provided. The developer includes the above toner and a carrier.

In accordance with some embodiments of the present invention, a toner storage unit is provided. The toner storage unit includes a container and the above toner stored in the container.

In accordance with some embodiments of the present invention, an image forming apparatus is provided. The image forming apparatus includes an electrostatic latent image bearer, an electrostatic latent image forming device, a developing device containing the above toner, a transfer device, and a fixing device. The electrostatic latent image forming device is configured to form an electrostatic latent image on the electrostatic latent image bearer. The developing device is configured to develop the electrostatic latent image on the electrostatic latent image bearer with the toner to form a toner image. The transfer device is configured to transfer the toner image from the electrostatic latent image onto a surface of a recording medium. The fixing device is configured to fix the toner image on the surface of the recording medium.

In accordance with some embodiments of the present invention, an image forming method is provided. The image forming method includes the processes of: forming an electrostatic latent image on an electrostatic latent image bearer; developing the electrostatic latent image on the electrostatic latent image bearer with the above toner to form a toner image; transferring the toner image from the electrostatic latent image bearer onto a surface of a recording medium; and fixing the toner image on the surface of the recording medium.

In accordance with some embodiments of the present invention, a method for producing printed matter is provided. The method includes the processes of: forming an electrostatic latent image on an electrostatic latent image bearer; developing the electrostatic latent image on the electrostatic latent image bearer with the above toner to form a toner image; transferring the toner image from the electrostatic latent image bearer onto a surface of a recording medium; and fixing the toner image on the surface of the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
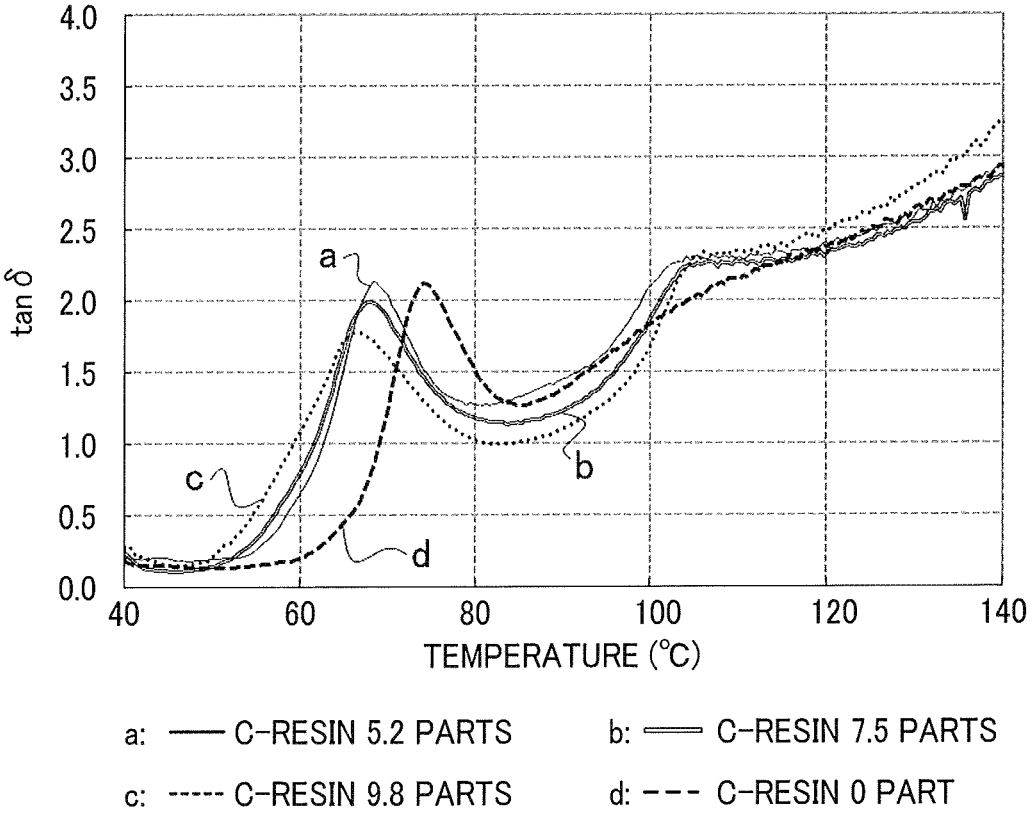
FIG. 1 is a temperature-dependent curve of loss tangent (tan δ) of a toner in accordance with some embodiments of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

A conventional toner is not enough to be satisfactory as a toner meeting the recent requirement, i.e., a toner having satisfactory low-temperature fixability, filming resistance, and charge stability.

Thus, a toner is demanded that has satisfactory low-temperature fixability, filming resistance, and charge stability and that can attain to form an image with high quality that can be retained for an extended period of time.

In accordance with some embodiments of the present invention, a toner having excellent low-temperature fixability, filming resistance, and charge stability is provided.

The inventors of the present invention have been studied to obtain a toner having satisfactory low-temperature fixability, filming resistance, and charge stability at the same time. As a result, the inventors have come to a conclusion that a toner including a resin component having crystallizing ability but not becoming a crystallized state in the toner can meet the above-described requirement. Such a toner is very different from conventional toner including a crystalline resin from technical aspect. The conventional toner has been attempting to improve low-temperature fixability by forming a phase-separated structure (i.e., sea-island structure) of the crystalline resin and other resins by making use of the crystallization ability of the crystalline resin. The present invention is achieved based on the above conclusion by the inventors.

In accordance with some embodiments of the present invention, a below-described toner is provided that meets the recent requirement described above.

Toner

The toner in accordance with some embodiments of the present invention contains at least two types of polyester resins and a release agent. The toner may optionally contain other components, if necessary.

When the toner is subjected to a dynamic viscoelasticity measurement at a frequency of 6.28 rad/sec to obtain a temperature-dependent curve of loss tangent (tan δ), and the temperature-dependent curve is differentiated one time with temperature, a resulting curve has a maximum value of 0.07 or more and a minimum value of 0.025 or less within a temperature range of from 85° C. to 110° C. In addition, when the toner is subjected to differential scanning calorimetry (DSC), an endothermic amount measured in a first temperature rising in the DSC is 3.5 J/g or less within a temperature range of from 85° C. to 120° C.

Curve Obtained by First-Order Differentiation of Temperature-Dependent Curve of Loss Tangent (Tan δ)

The above-noted dynamic viscoelasticity measurement is performed in the following manner.

Dynamic Viscoelasticity Measurement

A toner in an amount of 0.1 g is pelletized with a pressure of 30 MPa using a die having a diameter of 8 mm. The resulting pellet is set to an instrument ADVANCED RHEOMETRIC EXPANSION SYSTEM (product of TA Instruments) equipped with parallel cones having a diameter of 8 mm, and a measurement of loss tangent (tan δ) is performed at a frequency of 1.0 Hz, a temperature rising rate of 2.0° C./min, and a strain of 0.1% (automatic strain control: acceptable minimum stress is 1.0 g/m, acceptable maximum stress is 500 g/cm, maximum additional strain is 200%, and strain adjustment is 200%).

FIG. 1 is a temperature-dependent curve of loss tangent (tan δ) of a toner in accordance with some embodiments of the present invention. In FIG. 1, the symbols a to c denote toner samples including an easily-compatible latent crystalline resin (to be described in detail later) in different amounts. The symbol a denotes a toner sample including 5.2 parts by mass of the easily-compatible latent crystalline resin (hereinafter "C-resin"). The symbol b denotes a toner sample including 7.5 parts by mass of the C-resin. The symbol c denotes a toner sample including 9.8 parts by mass of the C-resin. The symbol d denotes a toner sample including no C-resin (i.e., 0 part by mass of the C-resin). The term "crystalline resin" generally refers to a resin having crystallizing ability and capable of becoming a crystallized state in toner. In the present disclosure, by contrast, a resin having crystallizing ability but not becoming a crystallized state in toner is used. Such a resin is referred to as "easily-compatible latent crystalline resin" in the present disclosure, to be distinguished from the conventional "crystalline resin".

As indicated in FIG. 1, a temperature-dependent curve of loss tangent (tan δ) of the toner in accordance with some embodiments of the present invention has a local maximum value in the range of from 2 to 3, more preferably from 2 to 2.5, within a temperature range of from 85° C. to 110° C.

Figure 2:
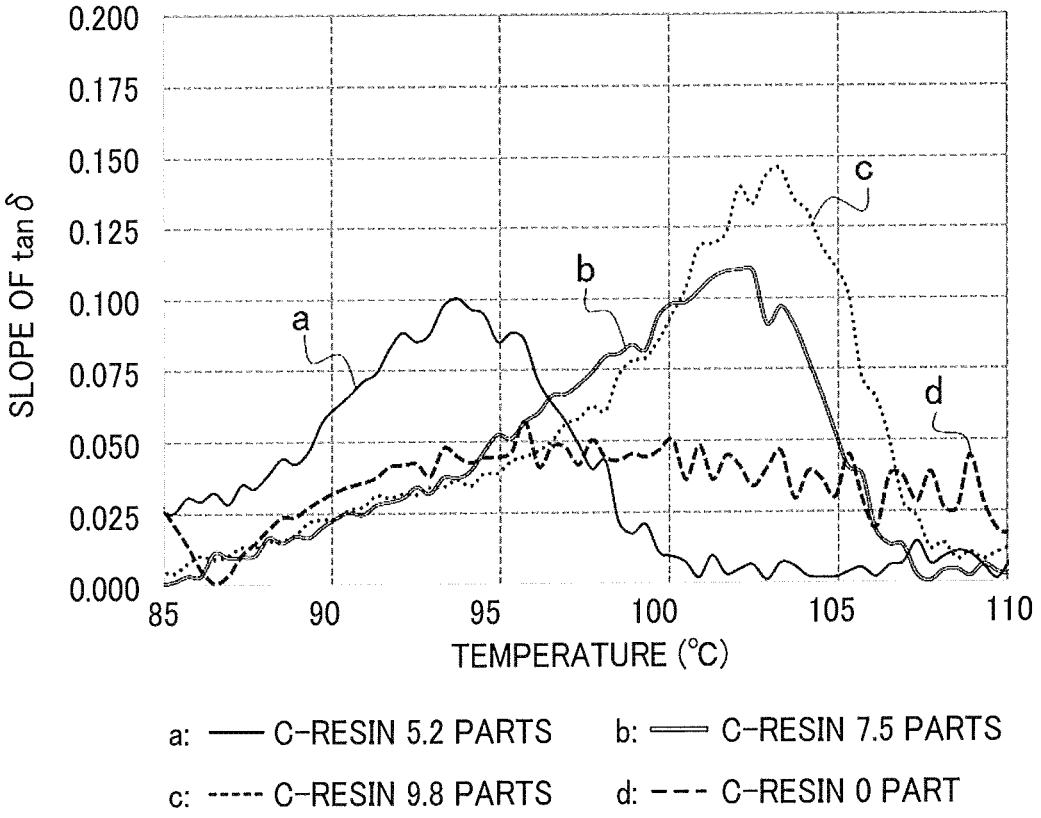
FIG. 2 is a curve obtained by first-order differentiation of the temperature-dependent curve of loss tangent (tan δ) illustrated in FIG. 1 with temperature.

As the temperature-dependent curves of loss tangent (tan δ) in FIG. 1 are each differentiated one time with temperature, curves illustrated in FIG. 2 are obtained.

Calculation of First-Order Differential Equation of Temperature-Dependent Curve A first-order differential equation is calculated by first-order differentiation of the above temperature-dependent curve of loss tangent (tan δ) obtained by the dynamic viscoelasticity measurement.

As indicated in FIG. 2, a curve drawn based on the first-order differential equation of the toner in accordance with some embodiments of the present invention has a maximum value of 0.07 or more and a minimum value of 0.025 or less within a temperature range of from 85° C. to 110° C.

When the maximum value is less than 0.07, low-temperature fixability deteriorates. When the minimum value is greater than 0.025, filming resistance deteriorates.

More preferably, the maximum value is 0.10 or more.

Endothermic Amount Measured by Differential Scanning calorimetry (DSC)

The above-noted differential scanning calorimetry is performed in the following manner.

Differential Scanning Calorimetry

A sample (toner) in an amount of 5 mg is weighed in an aluminum pan, and subjected to a temperature falling to 0° C. at a rate of 10° C./min and thereafter a temperature rising at a rate of 10° C./min using a differential scanning calorimeter (DSC-60 available from Shimadzu Corporation) to measure the peak endothermic amount within a temperature range of from 0° C. to 150° C.

The endothermic amount in the first temperature rising in the differential scanning calorimetry (DSC) within a temperature range of from 85° C. to 120° C. is 3.5 J/g or less. When the endothermic amount is greater than 3.5 J/g, charge stability and filming resistance deteriorate.

Preferably, the endothermic amount is 3.0 J/g or less.

State of Toner

The toner in accordance with some embodiments of the present invention includes a resin component having crystallizing ability but being in a non-crystallized state.

In the present disclosure, a non-crystallized state refers to a state in which the occurrence of crystallization is not confirmed, more specifically, a state in which no crystallized state is observed when the toner is observed under the following condition.

Toner Observation Condition

A method for observing crystalline components in toner may involve the following processes, but the method is not limited thereto. First, a toner is embedded in an epoxy resin and cut into an ultrathin section having a thickness of about 100 nm with an ultramicrotome ULTRACUT-S (available from Leica). The ultrathin section is dyed with ruthenium tetraoxide, thereafter observed with a transmission electron microscope (TEM), and photographed. The photograph is subjected to image evaluation.

Figure 3A:
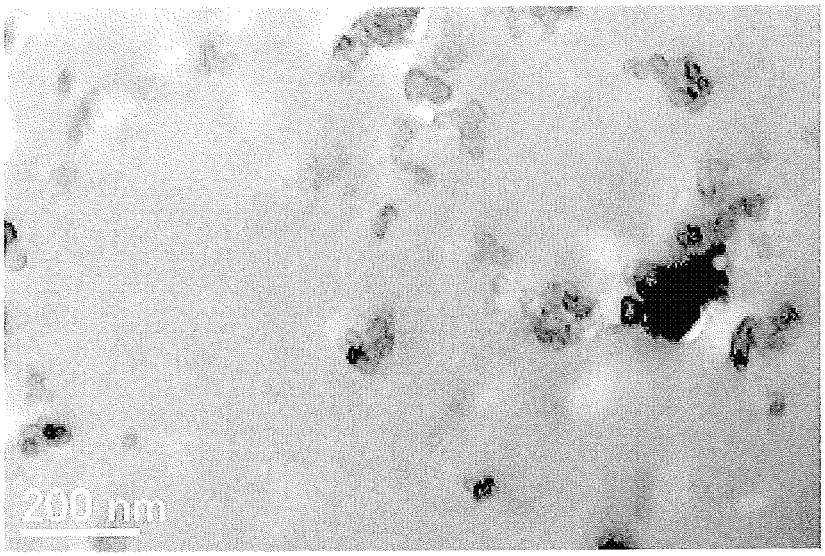
FIG. 3A is a TEM (transmission electron microscope) image of a toner in accordance with some embodiments of the present invention.

FIG. 3A is a TEM photographic image of the toner in accordance with some embodiments of the present invention obtained by the above-described procedure. In FIG. 3A, no portion in a crystallized state is observed.

A non-crystallized state of toner can be achieved by adjusting types and contents of resin components in the toner or adjusting producing method of the toner. Details of such adjustment are described later.

In FIG. 1, the symbol d denotes a toner sample including no easily-compatible latent crystalline resin, i.e., including no crystalline resin.

Referring to FIG. 2, with respect to the curve d representing the toner sample including no crystalline resin, neither maximum value nor minimum value thereof comes into the desired ranges defined above.

Such a toner including no crystalline resin is not able to achieve the effect of the present invention, as is clear from the evaluation results of Comparative Examples 1 and 2 to be described later.

Figure 3B:
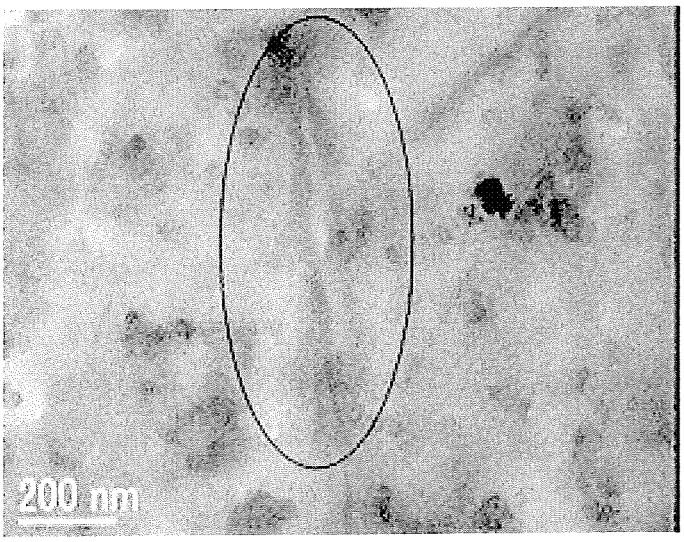
FIG. 3B RELATED ART
FIG. 3B is a TEM (transmission electron microscope) image of a related-art toner.

FIG. 3B is a TEM image of a related-art toner having a portion in a crystallized state. The portion in a crystallized state is observed as the encircled portion.

With respect to a related-art toner including a crystalline resin and having a phase-separated structure (sea-island structure) formed due to crystallizing ability of the crystalline resin, the endothermic amount measured by DSC is approximately 6 to 7 J/g, which is beyond the above-defined preferable range of 3.5 J/g or less.

Such a toner having a portion in a crystallized state cannot achieve the effect of the present invention, as is clear from the evaluation results of Comparative Example 3 to be described later.

Two or More Types of Polyester Resins

The toner in accordance with some embodiments of the present invention includes at least two types of polyester resins. The toner may optionally contain other binder resin components, if necessary.

At least one type of the polyester resins is an easily-compatible latent crystalline polyester resin that has crystallizing ability but not becoming a crystallized state.

The polyester resins other than the easily-compatible latent crystalline resin are not limited to particular materials. Examples thereof include amorphous polyester resins.

The amorphous polyester resin and the easily-compatible latent crystalline polyester resin are not limited to particular materials so long as a blend thereof exhibits maximum value, minimum value, and endothermic amount falling within their desired ranges.

Each of the amorphous polyester resin and the easily-compatible latent crystalline polyester resin can be obtained by condensation polymerization of an alcohol component with a carboxylic acid component.

Specific examples of the alcohol component include, but are not limited to, glycols, ethylated bisphenols (e.g., 1,4-bis(hydroxymethyl)cyclohexane and bisphenol A), divalent alcohol monomers, and trivalent or higher valences of polyol monomers.

Specific examples of the glycols include, but are not limited to, ethylene glycol, diethylene glycol, triethylene glycol, and propylene glycol.

Specific examples of the carboxylic acid component include, but are not limited to, divalent organic acid monomers and trivalent or higher valences of polycarboxylic acid monomers.

Specific examples of the divalent organic acid monomers include, but are not limited to, maleic acid, fumaric acid, phthalic acid, isophthalic acid, terephthalic acid, succinic acid, and malonic acid.

Specific examples of the trivalent or higher valences of polycarboxylic acid monomers include, but are not limited to, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

Easily-Compatible Latent Crystalline Polyester Resin

In order not to cause crystallization of the easily-compatible latent crystalline polyester resin, it is preferable that the amorphous polyester resin and the easily-compatible latent crystalline polyester resin are in a compatibilized state.

To achieve this, it is preferable that solubility parameter ("SP") ($cal^{1/2}/cm^{3/2}$) of the easily-compatible latent crystalline polyester resin ("SP(1)") and that of the amorphous polyester resin ("SP(2)") satisfy the following formula (1).

$$|SP(1)-SP(2)| \leq 4.5 \quad \text{Formula (1)}$$

Solubility Parameter (SP)

Solubility parameter (SP) refers to a numerical value indicating solvency behavior of one material to another material. SP is represented by the square root of cohesive energy density (CED) that indicates an intermolecular attracting force. CED is the amount of energy needed for vaporizing 1 mL of a material.

In the present disclosure, solubility parameter ($cal^{1/2}/cm^{3/2}$) is calculated from the following formula (I) based on the Fedors' method.

$$\text{Solubility Parameter (SP)}=(\text{CED})^{1/2}=(E/V)^{1/2} \quad \text{Formula (I)}$$

In the formula (I), E represents molecular cohesive energy (cal/mol) and V represents molecular volume ($cm^3$/mol). E and V are represented by the following formulae (II) and (III), respectively, where Δei and Δvi respectively represent vaporization energy and molar volume of an atomic group.

$$E=\Sigma\Delta ei \quad \text{Formula (II)}$$

$$V=\Sigma\Delta vi \quad \text{Formula (III)}$$

SP can be calculated in various ways. In the present disclosure, SP is calculated based on the Fedors' method widely used.

Detail of the above calculation method and data of vaporization energy Δei and molar volume Δvi of various atomic groups are available in a publication "Imoto, Minoru. Basic Theory of Gluing, Macromolecule Publication Meeting, Chapter 5 (pp. 89-103)".

Preferably, the carboxylic acid component of the easily-compatible latent crystalline polyester resin is fumaric acid.

Preferably, the content of the easily-compatible latent crystalline polyester resin in 100 parts by mass of the toner is in the range of from 3 to 10 parts by mass, more preferably from 6 to 9 parts by mass.

Amorphous Polyester Resin

The amorphous polyester resin may be comprised of either one type of amorphous polyester resin or two or more types of amorphous polyester resins.

Release Agent

The release agent is not limited to any particular material and selected according to the purpose. Examples of the release agent include, but are not limited to, low-molecular-weight polyolefin waxes, synthetic hydrocarbon waxes, natural waxes, petroleum waxes, higher fatty acids and metal salts thereof, higher fatty acid amides, synthetic ester waxes, and modification products of these waxes.

Specific examples of the low-molecular-weight polyolefin waxes include, but are not limited to, low-molecular-weight polyethylene and low-molecular-weight polypropylene.

Specific examples of the synthetic hydrocarbon waxes include, but are not limited to, Fischer-Tropsch wax.

Specific examples of the natural waxes include, but are not limited to, beeswax, carnauba wax, candelilla wax, rice wax, and montan wax.

Specific examples of the petroleum waxes include, but are not limited to, paraffin wax and micro-crystalline wax.

Specific examples of the higher fatty acids include, but are not limited to, stearic acid, palmitic acid, and myristic acid.

Among these release agents, carnauba wax and modification product thereof, polyethylene wax, and synthetic ester wax are preferable. In particular, a synthetic ester wax comprised of a single component is suitable for achieving both low-temperature fixability and filming resistance of the toner, because the melting temperature thereof is easy to adjust.

Each of these release agents can be used alone or in combination with others.

The content of the release agent in 100 parts by mass of the toner is preferably from 2 to 15 parts by mass. When the content rate of the release agent in the toner is 2% by mass or more, the occurrence of hot offset can be effectively prevented. When the content rate is 15% by mass or less, deterioration of transferability and durability can be prevented.

Preferably, the release agent has a melting point of from 70° C. to 150° C. When the melting point is 70° C. or higher, the toner is prevented from deteriorating its filming resistance. When the melting point is 150° C. or lower, releasing effect is sufficiently exerted.

Other Components

The toner may further contain other components such as a colorant, a charge controlling agent, an external additive, a fluidity improving agent, a cleanability improving agent, and a magnetic material.

Colorant

Examples of the colorant include, but are not limited to, pigments and dyes such as carbon black, lamp black, iron black, aniline blue, phthalocyanine blue, phthalocyanine green, Hansa Yellow G, Rhodamine 6C Lake, Calco Oil Blue, chrome yellow, quinacridone, benzidine yellow, rose bengal, and triarylmethane dyes. Each of these colorants can be used alone or in combination with others. The toner may be used for either black-and-white printing or full-color printing.

Charge Controlling Agent

The charge controlling agent is not limited to any particular material and selected according to the purpose. Examples of the charge controlling agent include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, metal salts of salicylic acid derivatives, and calixarene. Specific examples thereof include, but are not limited to, BONTRON 03 (nigrosine dye), BONTRON P-51 (quaternary ammonium salt), BONTRON S-34 (metal-containing azo dye), BONTRON E-82 (metal complex of oxynaphthoic acid), and BONTRON E-84, E-108, and E-304 (metal complexes of salicylic acid), available from Orient Chemical Industries Co., Ltd.; TP-302 and TP-415 (molybdenum complexes of quaternary ammonium salts), and TN-105 (salicylic acid derivative of zirconium compound (raw material: basic zirconium oxide complex hydrate of 3,5-bis(1,1-dimethylethyl)-2-hydroxybenzoate)), available from Hodogaya Chemical Co., Ltd.; COPY CHARGE PSY VP2038 (quaternary ammonium salt), COPY BLUE PR (triphenylmethane derivative), and COPY CHARGE NEG VP2036 and COPY CHARGE NX VP434 (quaternary ammonium salts), available from Hoechst AG; LRA-901, and LR-147 (boron complex), available from Japan Carlit Co., Ltd.; cooper phthalocyanine; perylene; quinacridone; azo pigments; and polymer compounds having a functional group such as sulfonic acid group, carboxyl group, and quaternary ammonium salt.

Toner Properties

Volume Average Particle Diameter of Toner

Preferably, the toner has a volume average particle diameter of from 4.5 to 7.0 μm, but the volume average particle diameter is not limited thereto.

When the volume average particle diameter is 4.5 μm or greater, deterioration of filming resistance is prevented, and deterioration of cleanability in a developing process or transfer efficiency in a transfer process is also effectively prevented. When the volume average particle diameter is 7.0 μm or less, deterioration of low-temperature fixability or image quality is effectively prevented.

The volume average particle diameter of toner can be measured by an instrument COULTER COUNTER TA II (available from Beckman Coulter, Inc., formerly Coulter Electronics).

Glass Transition Temperature (Tg) of Toner

Preferably, the toner has a glass transition temperature (Tg) of from 45° C. to 60° C. When Tg is 45° C. or higher, deterioration of filming resistance is effectively prevented. When Tg is 60° C. or lower, deterioration of low-temperature fixability is effectively prevented.

In the present disclosure, Tg of toner is determined from an endothermic curve measured by differential scanning calorimetry. Specifically, Tg is defined as a temperature at the intersection of an extended line of a base line of the endothermic curve at or below the temperature of the highest peak, and a tangent line of the endothermic curve, which indicates the maximum slope between the peak rising portion and the peak top.

Average Circularity of Toner

The average circularity of toner can be measured with a flow particle image analyzer FPIA-3000 (available from Sysmex Corporation). Preferably, the toner has an average circularity of from 0.92 to 0.95.

Method for Producing Toner

The toner in accordance with some embodiments of the present invention may be produced by any known pulverization method. Preferably, the toner is produced by a pulverization method including at least a melt-kneading process.

Specifically, the toner is preferably produced by a method including the processes of: mixing toner materials, including at least two or more types of polyester resins and a release agent and optionally other components such as a colorant and a charge controlling agent, in a dried state; melt-kneading the resulting mixture with a melt-kneader; and pulverizing the kneaded product.

In the melt-kneading process, the mixture of the toner materials is melt-kneaded by a melt-kneader. Specific examples of the melt-kneader include, but are not limited to, single-axis or double-axis continuous kneaders and batch-type kneaders using roll mill. Specific examples of commercially-available products of the melt-kneader include, but are not limited to, TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Co., Ltd., KOKNEADER from Buss Corporation, etc.

Preferably, the melt-kneading process is performed under an appropriate condition such that the molecular chains of the binder resin are not cut. Specifically, the melt-kneading temperature is determined based on the softening point of the binder resin. When the melt-kneading temperature is excessively higher than the softening point, molecular chains may be significantly cut. When the melt-kneading temperature is excessively lower than the softening point, toner components may not be well dispersed therein.

In the pulverizing process, the kneaded product is pulverized. Preferably, the kneaded product is first pulverized into coarse particles, and the coarse particles are then pulverized into fine particles. Suitable pulverization methods include a method which collides particles with a collision board in a jet stream; a method which collides particles with each other in a jet stream; and a method which pulverizes particles in a narrow gap formed between a rotor mechanically rotating and a stator.

This toner production method may further include a classification process in which fine particles obtained in the pulverization process are classified by size so that particles having a desired particle size are collected. In the classification process, ultrafine particles may be removed by cyclone separation, decantation, or centrifugal separation.

Developer

The developer in accordance with some embodiments of the present invention comprises at least the above-described toner and optionally other components such as a carrier.

The developer has excellent transferability and chargeability, and can reliably form high-quality image. The developer may be either one-component developer or two-component developer. To be used for high-speed printers corresponding to recent improvement in information processing speed, two-component developer is preferable, because the lifespan thereof can be extended.

The two-component developer can be prepared by mixing the above toner with a carrier. The content rate of the carrier in the two-component developer is preferably from 90% to 98% by mass, more preferably from 93% to 97% by mass.

Carrier

The carrier may comprise a core material and a resin layer that covers the core material.

Core Material

Specific examples of the core material include, but are not limited to, manganese-strontium or manganese-magnesium materials having a magnetization of from 50 to 90 emu/g. For securing image density, high magnetization materials, such as iron powders having a magnetization of 100 emu/g or more and magnetites having a magnetization of from 75 to 120 emu/g, are preferable. Additionally, low magnetization materials, such as copper-zinc materials having a magnetization of from 30 to 80 emu/g, are preferable for improving image quality, because such materials are capable of reducing the impact of the magnetic brush to a photoconductor.

Each of these materials can be used alone or in combination with others.

Toner Storage Unit

In the present disclosure, a toner storage unit refers to a unit that has a function of storing toner and that is storing the above toner. The toner storage unit may be in the form of, for example, a toner storage container, a developing device, or a process cartridge.

The toner storage container refers to a container storing the toner.

The developing device refers to a device storing the toner and having a developing unit configured to develop an electrostatic latent image into a toner image with the toner.

The process cartridge refers to a combined body of an electrostatic latent image bearer (simply "image bearer") with a developing unit storing the toner, detachably mountable on an image forming apparatus. The process cartridge may further include at least one of a charger, an irradiator, and a cleaner.

An image forming apparatus to which the toner storage unit is mounted can perform an image forming operation utilizing the above toner having excellent low-temperature fixability, filming resistance, and charge stability.

Image Forming Apparatus and Image Forming Method

An image forming apparatus in accordance with some embodiments of the present invention includes at least an electrostatic latent image bearer, an electrostatic latent image forming device, and a developing device, and optionally other members.

An image forming method in accordance with some embodiments of the present invention includes at least an electrostatic latent image forming process and a developing process, and optionally other processes.

The image forming method is preferably performed by the image forming apparatus. The electrostatic latent image forming process is preferably performed by the electrostatic latent image forming device. The developing process is preferably performed by the developing device. Other optional processes are preferably performed by other optional members.

More preferably, the image forming apparatus includes: an electrostatic latent image bearer; an electrostatic latent image forming device configured to form an electrostatic latent image on the electrostatic latent image bearer; a developing device containing the above toner, configured to develop the electrostatic latent image formed on the electrostatic latent image bearer into a toner image with the toner; a transfer device configured to transfer the toner image from the electrostatic latent image bearer onto a surface of a recording medium; and a fixing device configured to fix the toner image on the surface of the recording medium.

More preferably, the image forming method includes: an electrostatic latent image forming process in which an electrostatic latent image is formed on an electrostatic latent image bearer; a developing process in which the electrostatic latent image formed on the electrostatic latent image bearer is developed into a toner image with the above toner; a transfer process in which the toner image is transferred from the electrostatic latent image bearer onto a surface of a recording medium; and a fixing process in which the toner image is fixed on the surface of the recording medium.

In the developing device and the developing process, the above-described toner in accordance with some embodiments of the present invention is used. More preferably, a developer containing the above-described toner and other optional components, such as a carrier, is used to form the toner image.

An image forming apparatus in accordance with some embodiments of the present invention is described below with reference to FIG. 4. A full-color image forming apparatus 100A illustrated in FIG. 4 includes a photoconductor drum 10 (hereinafter "photoconductor 10") serving as the electrostatic latent image bearer, a charging roller 20 serving as the charger, an irradiator 30 serving as the irradiator, a developing device 40 serving as the developing device, an intermediate transfer medium 50, a cleaner 60 equipped with a cleaning blade, and a neutralization lamp 70.

The intermediate transfer medium 50 is in the form of an endless belt and is stretched taut by three rollers 51 disposed inside the loop of the endless belt. The intermediate transfer medium 50 is movable in the direction indicated by arrow in FIG. 4. One or two of the three rollers 51 also function(s) as transfer bias roller(s) for applying a predetermined transfer bias (primary transfer bias) to the intermediate transfer medium 50. In the vicinity of the intermediate transfer medium 50, a cleaner 90 equipped with a cleaning blade is disposed. A transfer roller 80, serving as the transfer device, that applies a transfer bias to a transfer sheet 95 for secondarily transferring a toner image thereon is disposed facing the intermediate transfer medium 50. Around the intermediate transfer medium 50, a corona charger 58 that gives charge to the toner image on the intermediate transfer medium 50 is disposed between the contact point of the intermediate transfer medium 50 with the photoconductor 10 and the contact point of the intermediate transfer medium 50 with the transfer sheet 95 relative to the direction of rotation of the intermediate transfer medium 50.

The developing device 40 includes a developing belt 41; and a black developing unit 45K, a yellow developing unit 45Y, a magenta developing unit 45M, and a cyan developing unit 45C each disposed around the developing belt 41. The black developing unit 45K includes a developer container 42K, a developer supply roller 43K, and a developing roller 44K. The yellow developing unit 45Y includes a developer container 42Y, a developer supply roller 43Y, and a developing roller 44Y. The magenta developing unit 45M includes a developer container 42M, a developer supply roller 43M, and a developing roller 44M. The cyan developing unit 45C includes a developer container 42C, a developer supply roller 43C, and a developing roller 44C. The developing belt 41 is in the form of an endless belt and stretched taut by multiple belt rollers. A part of the developing belt 41 is in contact with the photoconductor 10.

Figure 4:
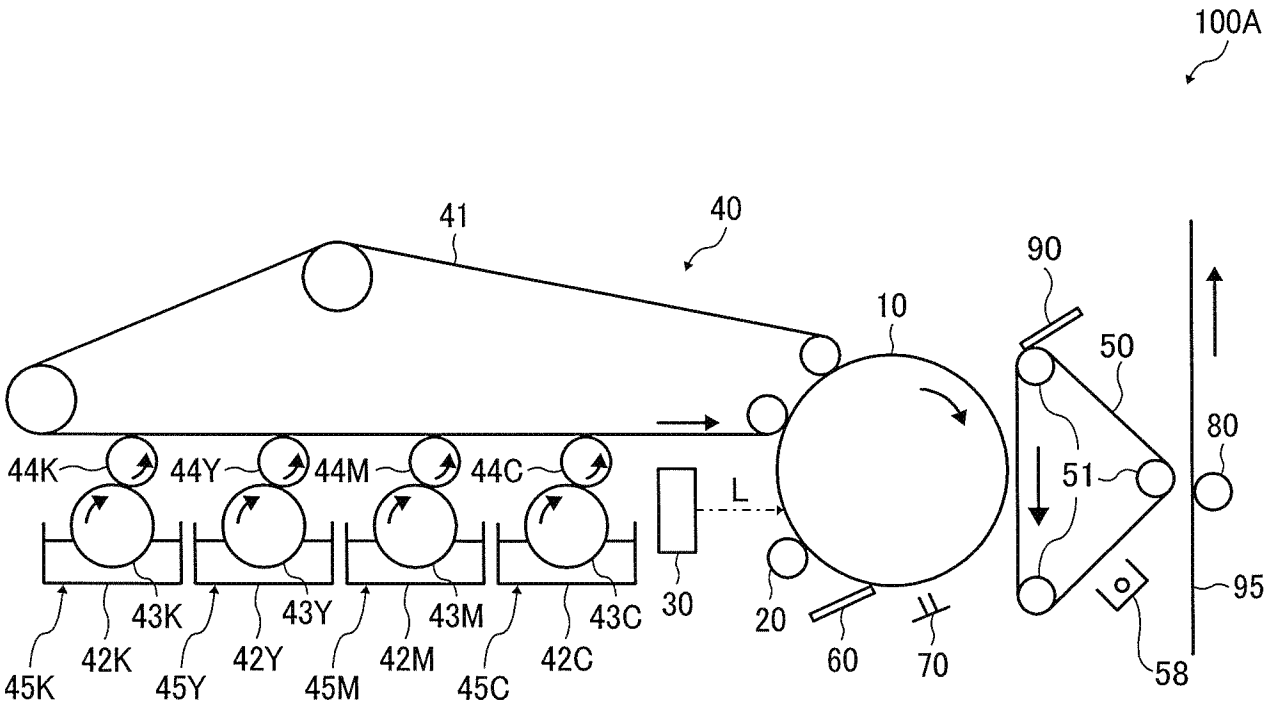
FIG. 4 is a schematic view of an image forming apparatus in accordance with some embodiments of the present invention.

In the image forming apparatus 100A illustrated in FIG. 4, the charging roller 20 uniformly charges the photoconductor drum 10. The irradiator 30 irradiates the photoconductor drum 10 with light L containing image information to form an electrostatic latent image thereon. The developing device 40 supplies toner to the electrostatic latent image formed on the photoconductor drum 10 to form a toner image. The toner image is primarily transferred onto the intermediate transfer medium 50 by a voltage applied from the roller 51 and secondarily transferred onto the transfer sheet 95. Thus, a transfer image is formed on the transfer sheet 95. Residual toner particles remaining on the photoconductor are removed by the cleaner 60. The charge of the photoconductor 10 is once eliminated by the neutralization lamp 70.

Figure 5:
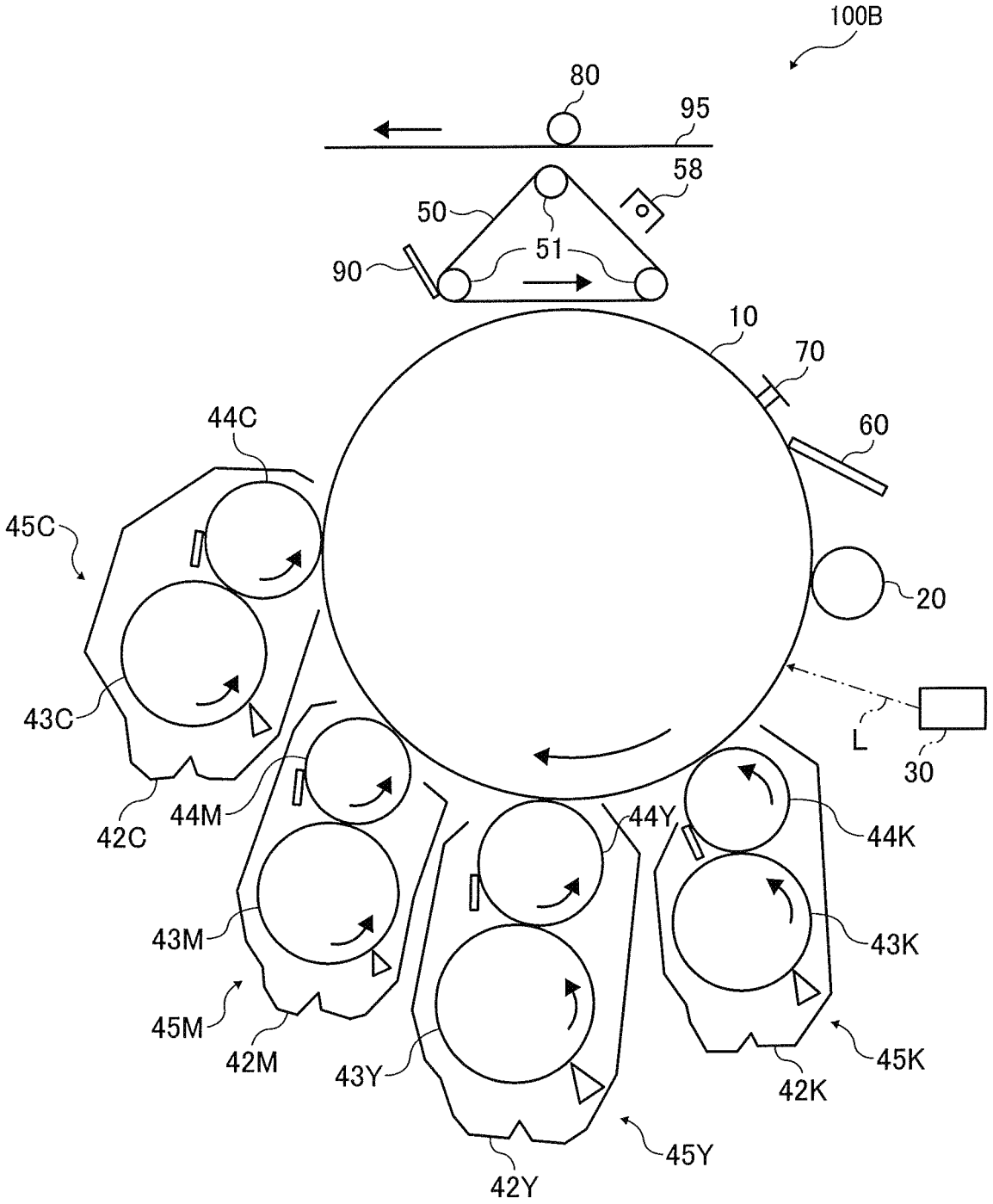
FIG. 5 is a schematic view of an image forming apparatus in accordance with some embodiments of the present invention.

FIG. 5 is a schematic view of another image forming apparatus in accordance with some embodiments of the present invention. An image forming apparatus 100B illustrated in FIG. 5 has a similar configuration to the image forming apparatus 100A illustrated in FIG. 4 except that the developing belt 41 is omitted and the black developing unit 45K, the yellow developing unit 45Y, the magenta developing unit 45M, and the cyan developing unit 45C are disposed facing the circumferential surface of the photoconductor 10.

Figure 6:
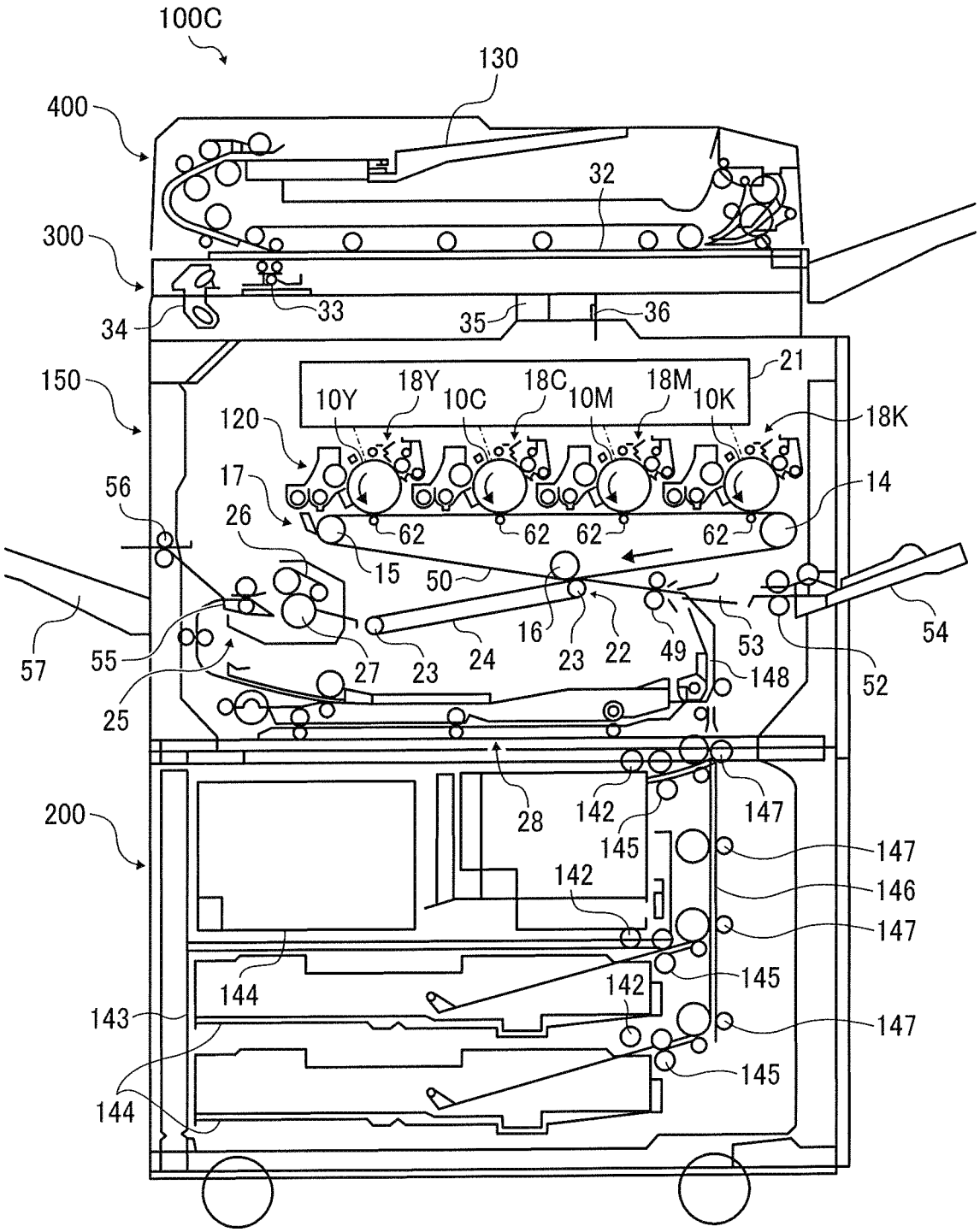
FIG. 6 is a schematic view of an image forming apparatus in accordance with some embodiments of the present invention.

FIG. 6 is a schematic view of another image forming apparatus in accordance with some embodiments of the present invention. An image forming apparatus 100C illustrated in FIG. 6, which is a tandem-type full-color image forming apparatus, includes a copier main body 150, a sheet feed table 200, a scanner 300, and an automatic document feeder (ADF) 400.

In the central part of the copier main body 150, an intermediate transfer medium 50 in the form of an endless belt is disposed. The intermediate transfer medium 50 is stretched taut by three rollers 14, 15, and 16 and rotatable in the direction indicated by arrow in FIG. 6. In the vicinity of the roller 15, a cleaner 17 equipped with a cleaning blade is disposed, for removing residual toner particles remaining on the intermediate transfer medium 50 after the toner image has been transferred onto a recording sheet. Four image forming units 18Y, 18C, 18M, and 18K for respectively forming yellow, cyan, magenta, and black images are arranged in tandem facing a part of the intermediate transfer belt 50 stretched between the support rollers 14 and 15, thus forming a tandem unit 120.

In the vicinity of the tandem unit 120, an irradiator 21 is disposed. On the opposite side of the tandem unit 120 relative to the intermediate transfer medium 50, a secondary transfer belt 24 is disposed. The secondary transfer belt 24 is in the form of an endless belt stretched taut with a pair of rollers 23. A recording sheet conveyed on the secondary transfer belt 24 and the intermediate transfer medium 50 can be brought into contact with each other at a position between the roller 16 and one of the rollers 23.

In the vicinity of the secondary transfer belt 24, a fixing device 25 is disposed. The fixing device 25 includes a fixing belt 26 and a pressing roller 27. The fixing belt 26 is in the form of an endless belt and stretched taut between a pair of rollers. The pressing roller 27 is pressed against the fixing belt 26. In the vicinity of the secondary transfer belt 24 and the fixing device 25, a sheet reversing device 28 is disposed for reversing the recording sheet so that images can be formed on both surfaces of the recording sheet.

A method for forming a full-color image using the image forming apparatus 100C is described below. First, a document is set on a document table 130 of the automatic document feeder 400. Alternatively, a document is set on a contact glass 32 of the scanner 300 while the automatic document feeder 400 is lifted up, followed by holding down of the automatic document feeder 400. As a start switch is pressed, in a case in which a document is set on the automatic document feeder 400, the document is conveyed onto the contact glass 32. In a case in which a document is set on the contact glass 32, the scanner 300 immediately starts driving so that a first traveling body 33 equipped with a light source and a second traveling body 34 equipped with a mirror start traveling. The first traveling body 33 directs light to the document and the second traveling body 34 reflects light reflected from the document toward a reading sensor 36 through an imaging lens 35. Thus, the document is read by the reading sensor 36 and converted into image information of yellow, magenta, cyan, and black.

Figure 7:
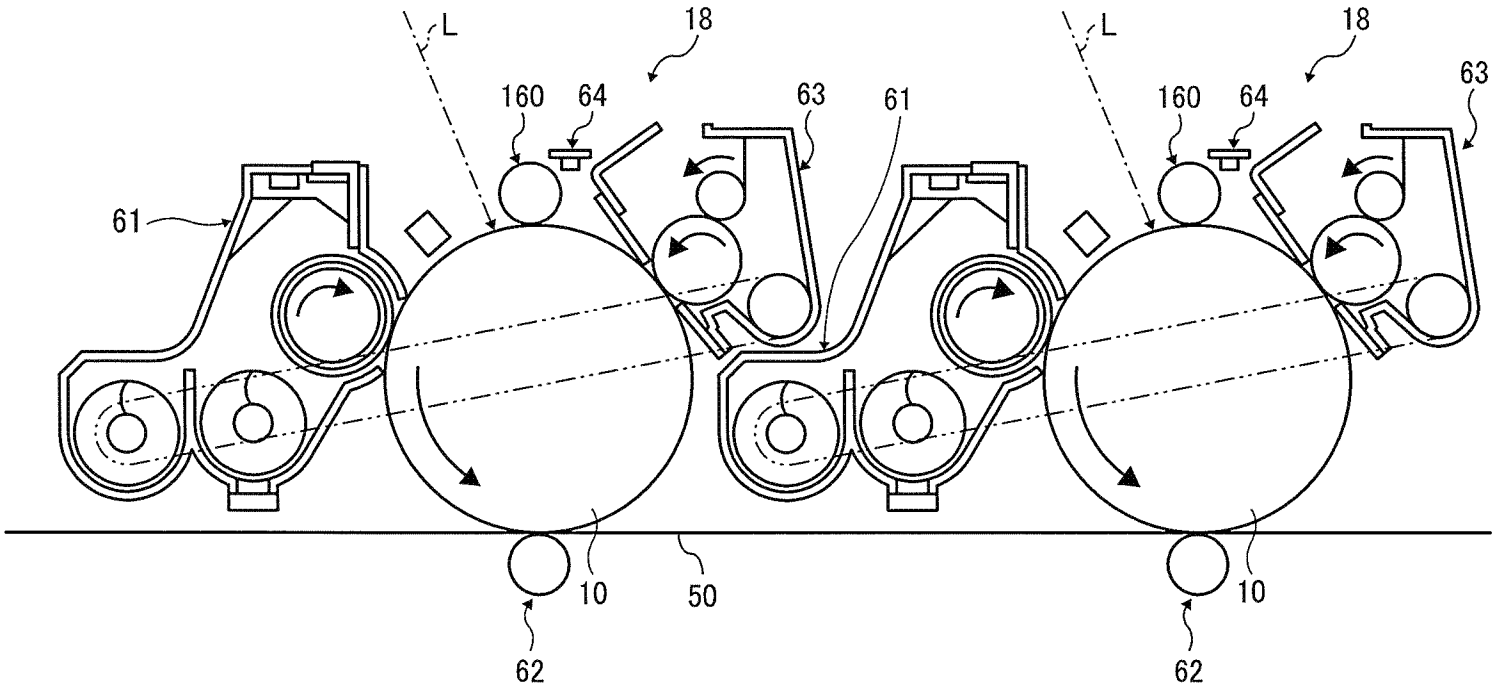
FIG. 7 is a partial magnified view of FIG. 6.

The image information of yellow, cyan, magenta, and black are respectively transmitted to the image forming units 18Y, 18C, 18M, and 18K in the tandem unit 120. The image forming units 18Y, 18C, 18M, and 18K form respective toner images of yellow, cyan, magenta, and black. Referring to FIG. 7, each of the image forming units 18Y, 18C, 18M, and 18K (each simply "image forming unit 18" in FIG. 7) in the tandem unit 120 includes several members as described below. The image forming units 18Y, 18C, 18M, and 18K include respective photoconductors 10Y, 10C, 10M, and 10K (each simply "photoconductor 10" in FIG. 7). Each image forming unit 18 further includes a charger 160 configured to uniformly charge the photoconductor 10. Each photoconductor 10 is irradiated with light L containing image information of each color, emitted from the irradiator 21, so that an electrostatic latent image of each color is formed thereon. Each image forming unit 18 further includes a developing device 61 configured to develop each electrostatic latent image with each color toner (yellow toner, magenta toner, cyan toner, or black toner) to form a toner image. Each image forming unit 18 further includes a transfer charger 62 configured to transfer the toner image onto the intermediate transfer medium 50. Each image forming unit 18 further includes a cleaner 63 and a neutralizer 64. Each image forming units 18 forms a single-color toner image (yellow toner image, magenta toner image, cyan toner image, or black toner image) based on the image information of each color. The toner images of yellow, cyan, magenta, and black are primarily transferred, in a sequential manner, onto the intermediate transfer medium 50 that is rotated by the rollers 14, 15, and 16. Specifically, the toner images of yellow, cyan, magenta, and black formed on the respective photoconductors 10Y, 10C, 10M, and 10K are primarily transferred in a sequential manner. Thus, the toner images of yellow, cyan, magenta, and black are superimposed on one another on the intermediate transfer medium 50, thus forming a composite full-color toner image.

At the same time, in the sheet feed table 200, one of sheet feed rollers 142 starts rotating to feed recording sheets from one of sheet feed cassettes 144 in a sheet bank 143. One of separation rollers 145 separates the sheets one by one and feeds them to a sheet feed path 146. Feed rollers 147 feed each sheet to a sheet feed path 148 in the copier main body 150. The sheet is stopped by striking a registration roller 49. Alternatively, sheets may be fed from a manual feed tray 54. In this case, a separation roller 52 separates the sheets one by one and feeds it to a manual sheet feed path 53. The sheet is stopped by striking the registration roller 49. The registration roller 49 is generally grounded. Alternatively, the registration roller 49 may be applied with a bias for the purpose of removing paper powders from the sheet. The registration roller 49 starts rotating to feed the sheet to between the intermediate transfer medium 50 and a secondary transfer device 22 in synchronization with an entry of the composite full-color toner image formed on the intermediate transfer medium 50 thereto. The secondary transfer device 22 secondarily transfers the composite full-color toner image onto the sheet.

Thus, the composite full-color image is formed on the sheet. After the composite full-color image is transferred, residual toner particles remaining on the intermediate transfer medium 50 are removed by the cleaner 17.

The sheet having the composite full-color toner image thereon is fed from the secondary transfer device 22 to the fixing device 25. The fixing device 25 fixes the composite full-color toner image on the sheet by application of heat and pressure. A switch claw 55 switches sheet feed paths so that the sheet is ejected by an ejection roller 56 and stacked on a sheet ejection tray 57. Alternatively, the switch claw 55 may switch sheet feed paths so that the sheet is introduced into the sheet reversing device 28 and gets reversed. The sheet is then introduced to the transfer position again so that another image is recorded on the back side of the sheet. Thereafter, the sheet is ejected by the ejection roller 56 and stacked on the sheet ejection tray 57.

Process Cartridge

A process cartridge in accordance with some embodiments of the present invention includes an electrostatic latent image bearer to bear an electrostatic latent image and a developing device to develop the electrostatic latent image into a toner image with the developer in accordance with some embodiments of the present invention. The process cartridge is configured to be detachably mountable on an image forming apparatus. The process cartridge may further include other members, if necessary.

The developing device includes at least a developer container containing the developer in accordance with some embodiments of the present invention, and a developer bearer to bear and convey the developer contained in the developer container. The developing device may further include a regulator to regulate the thickness of the developer layer borne on the developer bearer.

Figure 8:
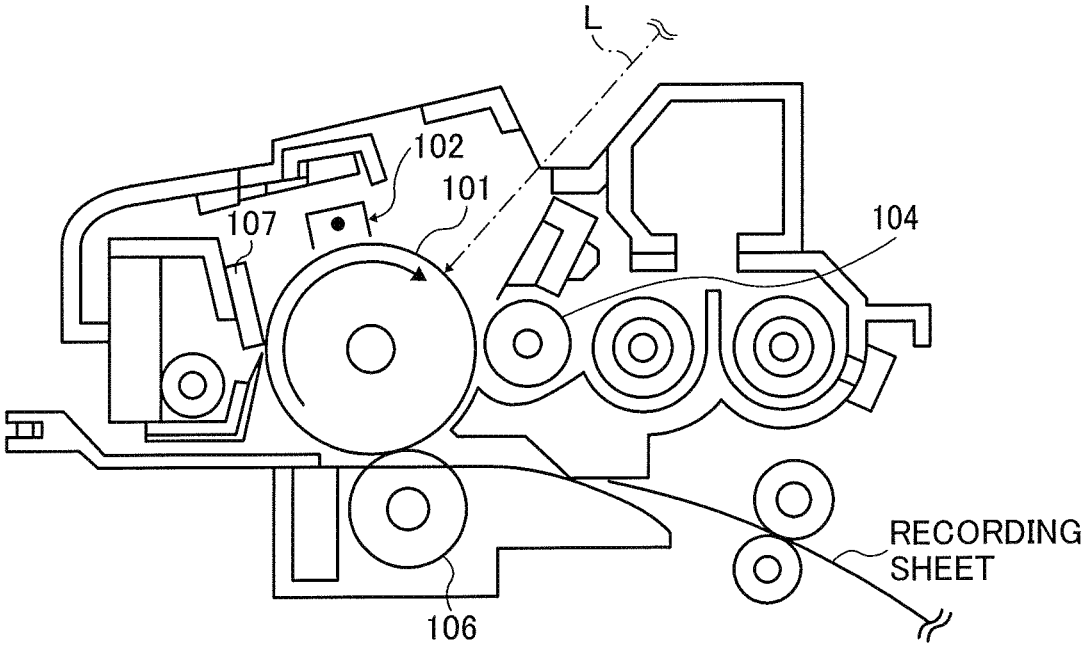
FIG. 8 is a schematic view of a process cartridge in accordance with some embodiments of the present invention.

As illustrated in FIG. 8, the process cartridge may include an electrophotographic photoconductor 101 and a developing device 104; and optional members including a charger 102, a transfer device 106, and a cleaner 107. The process cartridge may further include a neutralizer. The process cartridge is detachably mountable on an image forming apparatus.

EXAMPLES

The embodiments of the present invention is further described in detail with reference to the Examples but is not limited to the following Examples.

In the following Examples, calculation of first-order differential equation of temperature-dependent curve obtained by dynamic viscoelasticity measurement, measurement of endothermic amount and glass transition temperature by differential scanning calorimetry, and measurement of volume-average particle diameter were performed as follows.

Calculation of First-Order Differential Equation of Temperature-Dependent Curve Obtained by Dynamic Viscoelasticity Measurement A toner in an amount of 0.1 g was pelletized with a pressure of 30 MPa using a die having a diameter of 8 mm. The resulting pellet was set to an instrument ADVANCED RHEOMETRIC EXPANSION SYSTEM (product of TA Instruments) equipped with parallel cones having a diameter of 8 mm, and a measurement of loss tangent (tan δ) was performed at a frequency of 1.0 Hz, a temperature rising rate of 2.0° C./min, and a strain of 0.1% (automatic strain control: acceptable minimum stress was 1.0 g/m, acceptable maximum stress was 500 g/cm, maximum additional strain was 200%, and strain adjustment was 200%). A first-order differential equation was calculated by first-order differentiation of the above temperature-dependent curve of loss tangent (tan δ) obtained by the dynamic viscoelasticity measurement.

Measurement of Endothermic Amount by Differential Scanning Calorimetry (DSC)

A sample (toner) in an amount of 5 mg was weighed in an aluminum pan, and subjected to a temperature falling to 0° C. at a rate of 10° C./min and thereafter a temperature rising at a rate of 10° C./min using a differential scanning calorimeter (DSC-60 available from Shimadzu Corporation) to measure the peak endothermic amount within a temperature range of from 0° C. to 150° C.

Measurement of Glass Transition Temperature (Tg) by Differential Scanning calorimetry (DSC)

A sample (toner) in an amount of 5 mg was weighed in an aluminum pan, and subjected to a temperature falling to 0° C. at a rate of 10° C./min and thereafter a temperature rising at a rate of 10° C./min using a differential scanning calorimeter (DSC-60 available from Shimadzu Corporation) to measure the peak endothermic amount within a temperature range of from 0° C. to 150° C.

Tg was determined as a temperature at the intersection of an extended line of a base line of the endothermic curve at or below the temperature of the highest peak, and a tangent line of the endothermic curve which indicates the maximum slope between the peak rising portion and the peak top.

Measurement of Volume Average Particle Diameter

Volume average particle diameter of toner was measured with a COULTER MULTISIZER III (product of Beckman Coulter, Inc.). The aperture diameter was set to 100 μm. As an analysis software program, BECKMAN COULTER MULTISIZER 3 VERSION 3.51 (product of Beckman Coulter, Inc.) was used. A toner in an amount of 10 mg was dispersed in 5 mL of a 10% by mass solution of a surfactant (i.e., alkylbenzene sulfonate, NEOGEN SC-A product of DKS Co., Ltd.) using an ultrasonic disperser for 1 minute. After adding 25 mL of ISOTON III (product of Beckman Coulter, Inc.) thereto, the toner was further dispersed using an ultrasonic disperser for 1 minute. In a beaker, 100 mL of an electrolyte liquid and the above-prepared dispersion liquid were contained. The concentration of toner particles was adjusted such that 30,000 toner particles were subjected to a measurement of particle diameter over a period of 20 seconds. The volume average particle diameter was determined from the measured particle size distribution of 30,000 toner particles.

Synthesis of Polyester Resin A1

In a reaction vessel equipped with a cooling tube, a stirrer, and a nitrogen introducing tube, monomers described in Table 1, in the presence of tetrabutoxy titanate as a condensation catalyst, were allowed to react at 230° C. for 6 hours under nitrogen gas flow while removing the produced water. Subsequently, the monomers were allowed to react under reduced pressures of from 5 to 20 mmHg for 1 hour. Thus, an amorphous polyester resin A1 was prepared.

In Table 1, "(25 mol %)" added to "Bisphenol A (2,2) propylene oxide" indicates the content rate of "Bisphenol A (2,2) propylene oxide" in total alcohol components, when total acid components account for 50 mol % and total alcohol components account for 50 mol % of total monomers. (The same applies to the descriptions in Table 2.)

Synthesis of Polyester Resins B1 to B3

The procedure in "Synthesis of Polyester Resin A1" was repeated except for replacing the carboxylic acid components and alcohol components to those described in Table 2. Thus, amorphous polyester resins B1 to B3 were each prepared.

Synthesis of Polyester Resin C1

In a 5-L four-neck flask equipped with a nitrogen introducing tube, a dewatering tube, a stirrer, and a thermocouple, acid components and alcohol components described in Table 3 in amounts such that the molar ratio (OH/COOH) of hydroxyl groups to carboxyl groups became 0.9, in the presence of titanium tetraisopropoxide (500 ppm based on the resin components), were allowed to react at 180° C. for 10 hours, thereafter at 200° C. for 3 hours, and further under a pressure of 8.3 kPa for 2 hours. Thus, an easily-compatible latent crystalline polyester resin C1, to be used in Examples, was prepared.

Synthesis of Polyester Resin C2

The procedure in "Synthesis of Polyester Resin C1" was repeated except for replacing the carboxylic acid components and alcohol components to those described in Table 3. Thus, a crystalline polyester resin C2, to be used in Comparative Examples, was prepared.

TABLE 1

| Resin A | Tg | Carboxylic Acid Components | Alcohol Components | OH/COOH |
|---|---|---|---|---|
| A1 | 64° C. | Terephthalic acid | Bisphenol A (2,2) propylene oxide (25 mol %) Bisphenol A (2,2) ethylene oxide (25 mol %) | 1.1 |

TABLE 2

| Resin B | Tg | Carboxylic Acid Components | Alcohol Components | OH/COOH |
|---|---|---|---|---|
| B1 | 65° C. | Terephthalic acid | Bisphenol A (2,2) propylene oxide (25 mol %) Bisphenol A (2,2) ethylene oxide (25 mol %) | 1.1 |

TABLE 2-continued

| Resin B | Tg | Carboxylic Acid Components | Alcohol Components | OH/COOH |
|---|---|---|---|---|
| B2 | 75° C. | Terephthalic acid | Propylene glycol | 1.2 |
| B3 | 47° C. | Terephthalic acid | Propylene glycol (25 mol %) 1,4-Butanediol (25 mol %) | 1.2 |

TABLE 3

| Resin C | Carboxylic Acid Components | Alcohol Components |
|---|---|---|
| C1 | Fumaric acid | 1,6-Hexanediol |
| C2 | 1,16-Hexadecane dicarboxylic acid | 1,14-Tetradecanediol |

Example 1

Preparation of Pulverized Toners

Composition of Toner 1

Polyester resin A1: 24.2 parts by mass

Polyester resin B2: 60.0 parts by mass

Polyester resin C1: 3.2 parts by mass

Release agent (Synthetic ester wax): 4.8 parts by mass

Colorant (Phthalocyanine blue): 6.8 parts by mass

Charge Controlling Agent (Monoazo metal complex): 1.0 part by mass

The above-listed toner raw materials (also described in Table 4) were preliminarily mixed by a HENSCHEL MIXER (FM20B, product of Mitsui Miike Chemical Engineering Machinery, Co., Ltd.) and melt-kneaded by a two-axis extruder (PCM-30, product of Ikegai Corp) at 120° C. The kneaded product was rolled to have a thickness of 2.7 mm, and the resulting roll was cooled to room temperature by a belt cooler and pulverized into coarse particles having a diameter of from 200 to 300 μm by a hammer mill. The coarse particles were further pulverized into fine particles by a supersonic jet mill LABO JET (produced by Nippon Pneumatic Mfg. Co., Ltd.). The fine particles were classified by size using an air classifier (MDS-I produced by Nippon Pneumatic Mfg. Co., Ltd.) while appropriately adjusting the opening of the louver such that the weight average particle diameter became 5.8±0.2 μm. Thus, mother toner particles were prepared.

Next, 100 parts by mass of the mother toner particles were mixed with 1.0 part by mass of an additive (HDK-2000 available from Clariant) by a HENSCHEL MIXER. Thus, a toner 1 was prepared.

The toner 1 was subjected to measurements of the maximum value, minimum value, endothermic amount, glass transition temperature, and volume average particle diameter by the above-described procedures. Results are presented in Table 4.

The toner 1 in an amount of 5% by mass and a coating ferrite carrier in an amount of 95% by mass were uniformly mixed by a TURBULA MIXER (available from Willy A. Bachofen (WAB)) at a revolution of 48 rpm for 5 minutes. Thus, a developer 1 was prepared. The developer 1 was set in an image forming apparatus and subjected to the following evaluations for low-temperature fixability, filming resistance, and charge stability. Results are presented in Table 5.

Evaluation of Low-Temperature Fixability

The developer 1 was set in a copier (RICOH MPC 6003, product of Ricoh Co., Ltd.) and an image was output. Specifically, a solid image with a toner deposition amount of 0.4 mg/cm$^2$ was formed on a paper sheet (TYPE6200, product of Ricoh Co., Ltd.) through the process of irradiation, developing, and transferring. The linear velocity in the fixing process was 256 mm/sec. The solid image was sequentially formed on multiple paper sheets while varying the fixing temperature by 5 degrees, to determine the lowest temperature at which cold offset did not occur ("lowest fixable temperature"). Low-temperature fixability was evaluated according to the following criteria. The nip width of the fixing device was 11 mm.

Evaluation Criteria for Low-Temperature Fixability

5: The lowest fixable temperature was lower than 130° C.

4: The lowest fixable temperature was 130° C. or higher and lower than 140° C.

3: The lowest fixable temperature was 140° C. or higher and lower than 150° C.

2: The lowest fixable temperature was 150° C. or higher and lower than 160° C.

1: The lowest fixable temperature was 160° C. or higher.

Evaluation of Filming Resistance

The developer 1 was set in a copier (RICOH MPC 6003, product of Ricoh Co., Ltd.). A continuous sheet-feeding test was performed in which a solid image with a toner deposition amount of 0.4 mg/cm$^2$ was continuously formed on 2,000 paper sheets (TYPE6200, product of Ricoh Co., Ltd., A4 size) through the process of irradiation, developing, and transferring. After the test, the latent image bearer and the charger in the copier were visually observed to check contamination situation.

Evaluation Criteria for Filming Resistance

4: No contamination on the latent image bearer. No filming on the charger.

3: Slight contamination on the latent image bearer. Slight filming on the charger.

2: Slight contamination on the latent image bearer. Slight filming on the charger. Abnormal images were produced with time.

1: Slight contamination on the latent image bearer. Slight filming on the charger. Abnormal images were produced at an initial stage.

Evaluation of Charge Stability

A process of developing a white blank image was initiated and suspended. During the suspension, the developer present on the photoconductor was transferred onto a piece of tape. The piece of tape having the transferred developer thereon and that having no developer thereon were subjected to a measurement of image density using a 939 spectrodensitometer (available from X-Rite), and the difference therebetween was determined.

Evaluation Criteria for Charge Stability

3: The difference was less than 0.010.

2: The difference was 0.010 or more and less than 0.030.

1: The difference was 0.030 or more.

Examples 2 to 26

The procedure for preparing the toner 1 in Example 1 was repeated except for replacing the toner raw materials with those described in Table 4, thus preparing toners 2 to 26.

The toners 2 to 26 were each subjected to measurements of the maximum value, minimum value, endothermic amount, glass transition temperature, and volume average particle diameter in the same manner as the toner 1. Results are presented in Table 4.

The procedure for preparing the developer 1 in Example 1 was repeated except for replacing the toner 1 with each of the toners 2 to 26, thus preparing respective developers 2 to 26.

Each of the developers 2 to 26 was set in an image forming apparatus and subjected to the following evaluations for low-temperature fixability, filming resistance, and charge stability in the same manner as the developer 1. Results are presented in Table 5.

Comparative Examples 1 to 4

The procedure for preparing the toner 1 in Example 1 was repeated except for replacing the toner raw materials with those described in Table 4, thus preparing comparative toners 1 to 4.

The comparative toners 1 to 4 were each subjected to measurements of the maximum value, minimum value, endothermic amount, glass transition temperature, and volume average particle diameter in the same manner as the toner 1. Results are presented in Table 4.

The procedure for preparing the developer 1 in Example 1 was repeated except for replacing the toner 1 with each of the comparative toners 1 to 4, thus preparing respective comparative developers 1 to 4.

Each of the comparative developers 1 to 4 was set in an image forming apparatus and subjected to the following evaluations for low-temperature fixability, filming resistance, and charge stability in the same manner as the developer 1. Results are presented in Table 5.

TABLE 5

| | Results | | |
|---|---|---|---|
| | Low-temperature Fixability | Charge Stability | Filming Resistance |
| Example 1 | 4 | 3 | 4 |
| Example 2 | 4 | 3 | 4 |
| Example 3 | 5 | 3 | 4 |
| Example 4 | 5 | 3 | 4 |
| Example 5 | 5 | 3 | 4 |
| Example 6 | 5 | 2 | 3 |
| Example 7 | 5 | 3 | 3 |
| Example 8 | 4 | 3 | 4 |
| Example 9 | 4 | 3 | 4 |
| Example 10 | 3 | 3 | 4 |
| Example 11 | 5 | 3 | 2 |
| Example 12 | 3 | 3 | 3 |
| Example 13 | 3 | 3 | 3 |
| Example 14 | 2 | 3 | 4 |
| Example 15 | 5 | 3 | 3 |
| Example 16 | 3 | 3 | 4 |
| Example 17 | 5 | 3 | 2 |
| Example 18 | 4 | 3 | 3 |
| Example 19 | 4 | 3 | 3 |
| Example 20 | 2 | 3 | 4 |
| Example 21 | 5 | 2 | 3 |
| Example 22 | 3 | 2 | 4 |
| Example 23 | 5 | 2 | 2 |
| Example 24 | 4 | 2 | 3 |
| Example 25 | 4 | 2 | 3 |

TABLE 4

| | Resin A | | Resin B | | Resin C | | Toner Properties | | | | |
|---|---|---|---|---|---|---|---|---|---|---|---|
| | Type | Content (parts by mass) | Type | Content (parts by mass) | Type | Content (parts by mass) | tanδ Differential Curve Max. Value | tanδ Differential Curve Min. Value | Endothermic Amount (J/g) | Tg (° C.) | Volume Average Particle Diameter (μm) |
| Example 1 | A1 | 24.2 | B1 | 60.0 | C1 | 3.2 | 0.07 | 0.01 | 0 | 58 | 5.8 |
| Example 2 | A1 | 23.7 | B1 | 58.5 | C1 | 5.2 | 0.09 | 0.01 | 0.15 | 56 | 5.8 |
| Example 3 | A1 | 23.6 | B1 | 58.1 | C1 | 5.7 | 0.10 | 0.01 | 0.30 | 55 | 5.8 |
| Example 4 | A1 | 23.1 | B1 | 56.8 | C1 | 7.5 | 0.13 | 0.01 | 1.1 | 53 | 5.8 |
| Example 5 | A1 | 22.7 | B1 | 55.3 | C1 | 9.4 | 0.15 | 0.01 | 3.0 | 50 | 5.8 |
| Example 6 | A1 | 22.5 | B1 | 55.1 | C1 | 9.8 | 0.15 | 0.01 | 3.1 | 50 | 5.8 |
| Example 7 | A1 | 23.7 | B1 | 58.5 | C1 | 5.2 | 0.09 | 0.01 | 0.15 | 56 | 4.4 |
| Example 8 | A1 | 23.7 | B1 | 58.5 | C1 | 5.2 | 0.09 | 0.01 | 0.15 | 56 | 4.5 |
| Example 9 | A1 | 23.7 | B1 | 58.5 | C1 | 5.2 | 0.09 | 0.01 | 0.15 | 56 | 7.0 |
| Example 10 | A1 | 23.7 | B1 | 58.5 | C1 | 5.2 | 0.09 | 0.01 | 0.15 | 56 | 7.1 |
| Example 11 | A1 | 19.4 | B3 | 62.8 | C1 | 5.2 | 0.09 | 0.01 | 0.15 | 43 | 4.4 |
| Example 12 | A1 | 37.5 | B2 | 44.7 | C1 | 5.2 | 0.09 | 0.01 | 0.15 | 62 | 4.4 |
| Example 13 | A1 | 19.4 | B3 | 62.8 | C1 | 5.2 | 0.09 | 0.01 | 0.15 | 43 | 8.0 |
| Example14 | A1 | 37.5 | B2 | 44.7 | C1 | 5.2 | 0.09 | 0.01 | 0.15 | 62 | 8.0 |
| Example 15 | A1 | 23.1 | B1 | 56.8 | C1 | 7.5 | 0.13 | 0.01 | 1.1 | 53 | 4.0 |
| Example 16 | A1 | 23.1 | B1 | 56.8 | C1 | 7.5 | 0.13 | 0.01 | 1.1 | 53 | 8.0 |
| Example 17 | A1 | 33.1 | B3 | 46.8 | C1 | 7.5 | 0.13 | 0.01 | 1.1 | 43 | 4.0 |
| Example 18 | A1 | 14.6 | B2 | 65.3 | C1 | 7.5 | 0.13 | 0.01 | 1.1 | 62 | 4.0 |
| Example 19 | A1 | 33.1 | B3 | 46.8 | C1 | 7.5 | 0.13 | 0.01 | 1.1 | 43 | 8.0 |
| Example 20 | A1 | 14.6 | B2 | 65.3 | C1 | 7.5 | 0.13 | 0.01 | 1.1 | 62 | 8.0 |
| Example 21 | A1 | 22.5 | B1 | 55.1 | C1 | 9.8 | 0.15 | 0.01 | 3.1 | 50 | 4.0 |
| Example 22 | A1 | 22.5 | B1 | 55.1 | C1 | 9.8 | 0.15 | 0.01 | 3.1 | 50 | 8.0 |
| Example 23 | A1 | 46.1 | B3 | 31.5 | C1 | 9.8 | 0.15 | 0.01 | 3.1 | 43 | 4.0 |
| Example 24 | — | 0.0 | B2 | 77.6 | C1 | 9.8 | 0.15 | 0.01 | 3.1 | 62 | 4.0 |
| Example 25 | A1 | 46.1 | B3 | 31.5 | C1 | 9.8 | 0.15 | 0.01 | 3.1 | 43 | 8.0 |
| Example 26 | — | 0.0 | B2 | 77.6 | C1 | 9.8 | 0.15 | 0.01 | 3.1 | 62 | 8.0 |
| Comparative Example 1 | A1 | 22.5 | B1 | 55.1 | C1 | 9.8 | 0.06 | 0.01 | 0 | 59 | 5.8 |
| Comparative Example 2 | — | 0.0 | B3 | 87.4 | — | 0.0 | 0.20 | 0.03 | 0 | 47 | 5.8 |
| Comparative Example 3 | A1 | 22.5 | B1 | 54.9 | C2 | 10.0 | 2.00 | 0.01 | 6.41 | 50 | 5.8 |
| Comparative Example 4 | A1 | 22.3 | B1 | 54.1 | C1 | 11.0 | 0.17 | 0.01 | 3.6 | 49 | 5.8 |

TABLE 5-continued

| | Results | | |
|---|---|---|---|
| | Low-temperature Fixability | Charge Stability | Filming Resistance |
| Example 26 | 2 | 2 | 4 |
| Comparative Example 1 | 1 | 3 | 4 |
| Comparative Example 2 | 5 | 3 | 1 |
| Comparative Example 3 | 5 | 1 | 3 |
| Comparative Example 4 | 5 | 1 | 3 |

In accordance with some embodiments of the present invention, a toner is provided that has excellent low-temperature fixability, charge stability, and filming resistance and that is capable of forming high-quality image for an extended period of time.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner comprising:

an amorphous polyester resin and an easily-compatible latent crystalline polyester resin, wherein each of the two polyester resins is obtained by condensation polymerization of an alcohol component and a carboxylic acid component; and a release agent, wherein the amorphous polyester resin comprises at least one member selected from the group consisting of bisphenol A propylene oxide, bisphenol A ethylene oxide, and propylene glycol as the alcohol component, and comprises terephthalic acid as the carboxylic acid component;

wherein the easily-compatible latent crystalline polyester resin comprises 1,6-hexanediol as the alcohol component, and comprises fumaric acid as the carboxylic acid component, wherein, when the toner is subjected to a dynamic viscoelasticity measurement at a frequency of 6.28 rad/sec to obtain a temperature-dependent curve of loss tangent (tan δ), and the temperature-dependent curve is differentiated one time with temperature, a resulting curve has a maximum value of 0.07 or more and a minimum value of 0.025 or less within a temperature range of from 85° C. to 110° C., and wherein, when the toner is subjected to a differential scanning calorimetry (DSC), an endothermic amount measured in a first temperature rising in the DSC is 3.5 J/g or less within a temperature range of from 85° C. to 120° C.

2. The toner of claim 1, wherein the endothermic amount is 3.0 J/g or less.

3. The toner of claim 1, wherein the maximum value is 0.10 or more and the minimum value is 0.025 or less.

4. The toner of claim 1, wherein the toner has a glass transition temperature (Tg) of from 45° C. to 60° C.

5. The toner of claim 1, wherein the toner has a volume average particle diameter of from 4.5 to 7.0 μm.

6. The toner of claim 1, wherein the amorphous polyester resin and the easily-compatible latent crystalline polyester resin comprise a first polyester resin having a first solubility parameter SP(1), and a second polyester resin having a second solubility parameter SP(2), wherein:

$$|SP(1)-SP(2)| \leq 4.5\ cal^{1/2}/cm^{3/2}.$$

7. The toner of claim 1, wherein the easily-compatible latent crystalline polyester resin is a polyester synthesized from fumaric acid and 1,6-hexanediol.

8. The toner of claim 1, further comprising a second amorphous polyester resin.

9. A developer comprising:

the toner of claim 1; and a carrier.

10. A toner storage unit comprising:

a container; and the toner of claim 1 stored in the container.

11. An image forming apparatus comprising:

an electrostatic latent image bearer;

an electrostatic latent image forming device configured to form an electrostatic latent image on the electrostatic latent image bearer;

a developing device containing the toner of claim 1, configured to develop the electrostatic latent image on the electrostatic latent image bearer with the toner to form a toner image;

a transfer device configured to transfer the toner image from the electrostatic latent image onto a surface of a recording medium; and a fixing device configured to fix the toner image on the surface of the recording medium.

12. An image forming method comprising:

forming an electrostatic latent image on an electrostatic latent image bearer;

developing the electrostatic latent image on the electrostatic latent image bearer with the toner of claim 1 to form a toner image;

transferring the toner image from the electrostatic latent image bearer onto a surface of a recording medium; and fixing the toner image on the surface of the recording medium.

13. A method for producing printed matter, comprising:

forming an electrostatic latent image on an electrostatic latent image bearer;

developing the electrostatic latent image on the electrostatic latent image bearer with the toner of claim 1 to form a toner image;

transferring the toner image from the electrostatic latent image bearer onto a surface of a recording medium; and fixing the toner image on the surface of the recording medium.

* * * * *